US009586106B2

(12) United States Patent
Yashiki

(10) Patent No.: US 9,586,106 B2
(45) Date of Patent: Mar. 7, 2017

(54) GOLF CLUB SHAFT

(71) Applicant: DUNLOP SPORTS CO. LTD., Kobe-shi, Hyogo (JP)

(72) Inventor: Tatsuya Yashiki, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/791,753

(22) Filed: Jul. 6, 2015

(65) Prior Publication Data

US 2016/0016056 A1 Jan. 21, 2016

(30) Foreign Application Priority Data

Jul. 15, 2014 (JP) ..... 2014-144967

(51) Int. Cl.
*A63B 53/10* (2015.01)

(52) U.S. Cl.
CPC ..... *A63B 53/10* (2013.01); *A63B 2209/023* (2013.01)

(58) Field of Classification Search
CPC ..... A63B 53/10; A63B 2209/023
See application file for complete search history.

(56) References Cited

U.S. PATENT DOCUMENTS 5,265,872 A * 11/1993 Tennent ..... A63B 53/10 273/DIG. 23
5,620,380 A * 4/1997 Tennent ..... A63B 53/10 273/DIG. 23
6,110,056 A * 8/2000 Yamamoto ..... A63B 53/00 273/DIG. 23
6,322,458 B1 * 11/2001 Kusumoto ..... A63B 53/10 473/316
6,953,402 B2 * 10/2005 Oyama ..... A63B 53/10 473/319
7,918,746 B2 * 4/2011 Kumamoto ..... A63B 53/10 473/319
8,882,607 B2 * 11/2014 Nakamura ..... A63B 53/00 473/292
9,079,075 B2 * 7/2015 Nakamura ..... A63B 53/00
2012/0295734 A1 11/2012 Hasegawa et al.
2013/0095949 A1 * 4/2013 Hasegawa ..... A63B 53/10 473/318
2014/0106895 A1 * 4/2014 Hasegawa ..... A63B 53/10 473/319

FOREIGN PATENT DOCUMENTS

JP 2008049608 A * 3/2008
JP 2009066130 A * 4/2009
JP 2014-76142 A 5/2014

* cited by examiner

*Primary Examiner* — Stephen Blau
(74) *Attorney, Agent, or Firm* — Birch, Stewart, Kolasch & Birch, LLP

(57) ABSTRACT

A shaft 6 includes a first butt partial sheet s4 and a second butt partial sheet s5. The first butt partial sheet s4 includes a first tapered part TP1. The second butt partial sheet includes a second tapered part TP2. The first butt partial sheet s4 and the second butt partial sheet s5 satisfy the following (1) to (4). L11, L12, L21, Lt1 and Lt2 are shown in FIG. 3.

$$L11>L21 \quad (1)$$

$$Lt1 \geq CF1 \times Te1/20 \quad (2)$$

$$Lt2 \geq CF2 \times Te2/20 \quad (3)$$

$$L21-L12<50 \quad (4)$$

5 Claims, 7 Drawing Sheets

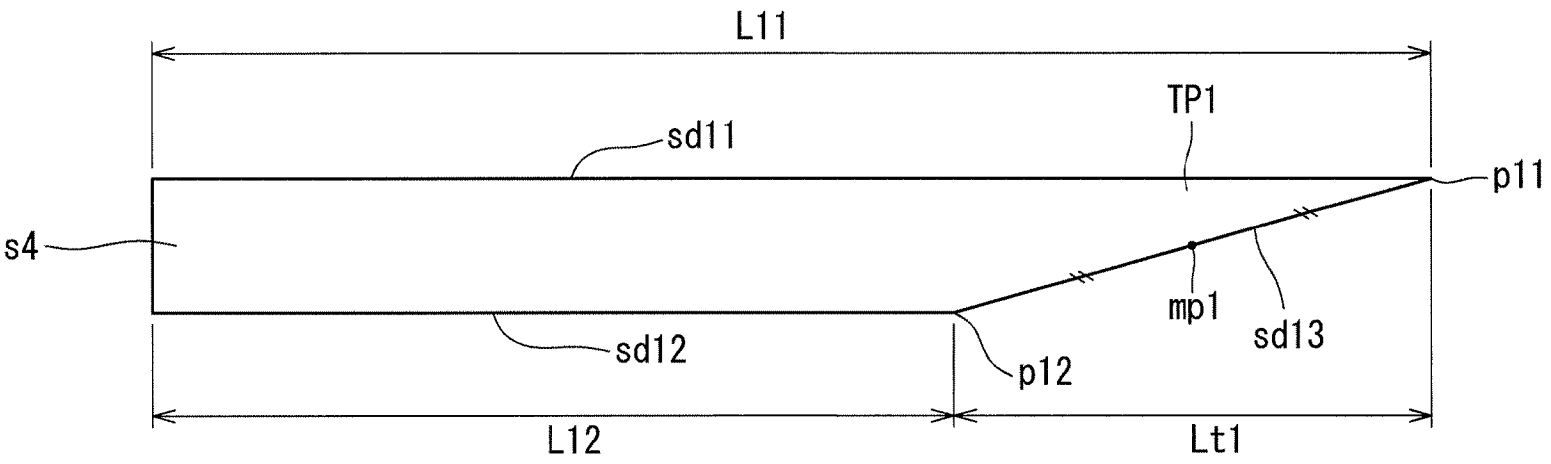
FIG. 4
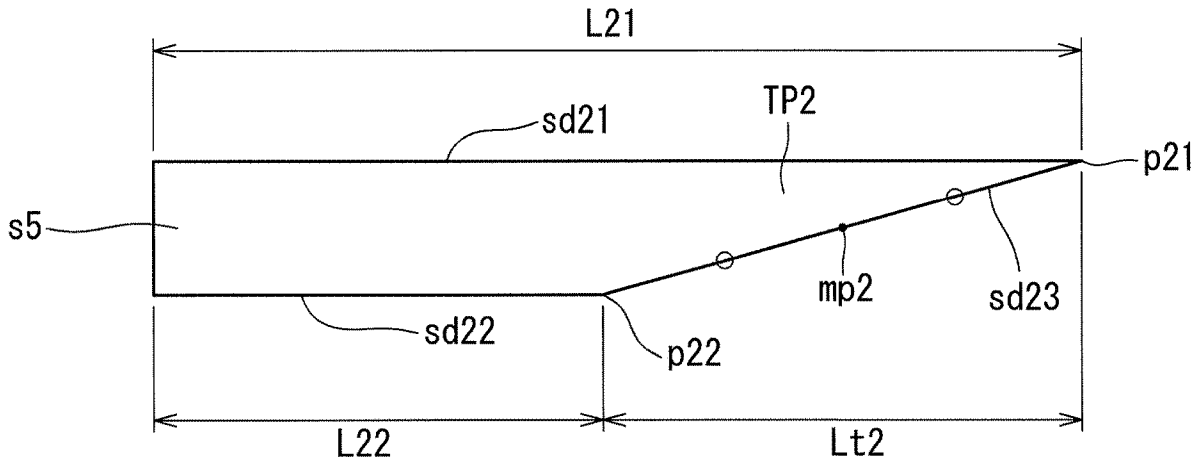

GOLF CLUB SHAFT

This application claims priority on Patent Application No. 2014-144967 filed in JAPAN on Jul. 15, 2014. The entire contents of this Japanese Patent Application are hereby incorporated by reference.

BACKGROUND OF THE INVENTION

Field of the Invention

The present invention relates to a golf club shaft.

Description of the Related Art

A so-called carbon shaft has been known as a golf club shaft. A sheet winding process has been known as a method for manufacturing the carbon shaft. In the sheet winding process, a laminated constitution is obtained by winding a prepreg around a mandrel.

The prepreg includes a resin and a fiber. Many types of prepregs exist. A plurality of prepregs having different resin contents have been known. In the present application, the prepreg is also referred to as a prepreg sheet or a sheet.

In the sheet winding process, the type of a sheet, the disposal of the sheet, and the orientation of a fiber can be selected. The sheet winding process is excellent in a degree of freedom in design.

Japanese Patent Application Laid-Open No. 2012-239574 (US2012/0295734) discloses a golf club shaft having a shaft weight of equal to or greater than 52 g and a ratio (Lg/Ls) of a center of gravity of the shaft of equal to or greater than 0.52 but equal to or less than 0.65. This shaft has an excellent flight distance performance.

Japanese Patent Application Laid-Open No. 2014-76142 discloses a golf club shaft which includes a tip end partial layer having a glass fiber reinforced layer.

SUMMARY OF THE INVENTION

Easiness of swing can be accomplished by increasing a ratio of a center of gravity of a shaft. In other words, the easiness of swing can be accomplished by disposing the center of gravity of the shaft close to butt. The easiness of swing can contribute to increase in flight distance.

A butt partial layer is used in a shaft described in JP2012-239574. The butt partial layer is disposed thereby to make the center of gravity of the shaft close to the butt end. The butt partial layer can contribute to increase in the ratio of the center of gravity of the shaft. The present invention can further enhance the performance of a shaft having the butt partial layer.

The demand for a shaft has been more and more increased. A shaft that is easier to swing and has an excellent feeling is preferable.

It is an objective of the present invention to provide a golf club shaft which has a stable shaft behavior during a swing.

A preferable golf club shaft according to the present invention includes a plurality of fiber reinforced layers. The fiber reinforced layers are formed by a plurality of wound prepreg sheets. The sheets include a full length sheet disposed wholly in an axial direction of the shaft, a tip partial sheet disposed to include a position separated by 20 mm from a tip end of the shaft, a first butt partial sheet disposed to include a position separated by 100 mm from a butt end of the shaft, and a second butt partial sheet disposed to include the position separated by 100 mm from the butt end. The first butt partial sheet includes a first tapered part. The second butt partial sheet includes a second tapered part. A fiber weight per unit area of the first butt partial sheet is defined as CF1 (g/m$^2$), and a fiber elastic modulus of the first butt partial sheet is defined as Te1 (tf/mm$^2$). A fiber weight per unit area of the second butt partial sheet is defined as CF2 (g/m$^2$), and a fiber elastic modulus of the second butt partial sheet is defined as Te2 (tf/mm$^2$). An axial-directional length of a long side of the first butt partial sheet is defined as L11 (mm), and an axial-directional length of a short side of the first butt partial sheet is defined as L12 (mm). An axial-directional length of a long side of the second butt partial sheet is defined as L21 (mm), and an axial-directional length of a short side of the second butt partial sheet is defined as L22 (mm). An axial-directional length of the first tapered part is defined as Lt1 (mm). An axial-directional length of the second tapered part is defined as Lt2 (mm). The shaft satisfies the following formulas (1), (2), (3) and (4).

$$L11>L21 \quad (1)$$

$$Lt1 \geq CF1 \times Te1/20 \quad (2)$$

$$Lt2 \geq CF2 \times Te2/20 \quad (3)$$

$$L21-L12<50 \quad (4)$$

Preferably, an EI change rate is equal to or less than 13 kgf·m$^2$/m over the whole shaft.

A distance between the tip end and the center of gravity of the shaft is defined as Lg, and a full length of the shaft is defined as Ls. Preferably, Lg/Ls is equal to or greater than 0.555.

Preferably, the full length sheet includes a full length bias sheet. In the full length bias sheet, a total width at the tip end is defined as Wt, and a total width at the butt end is defined as Wb. Preferably, Wb/Wt is equal to or greater than 2.

Preferably, the tip partial sheet includes a glass fiber reinforced sheet.

BRIEF DESCRIPTION OF THE DRAWINGS

FIG. 4 is enlarged views of the first butt partial sheet and the second butt partial sheet in a modified embodiment;

DESCRIPTION OF THE PREFERRED EMBODIMENTS

Hereinafter, the present invention will be described in detail according to the preferred embodiments with appropriate references to the accompanying drawings.

The term "layer" and the term "sheet" are used in the present application. The "layer" is termed after being wound. Meanwhile, the "sheet" is termed before being wound. The "layer" is formed by winding the "sheet". That is, the wound "sheet" forms the "layer".

In the present application, an "inside" means an inside in a radial direction of a shaft. In the present application, an "outside" means an outside in the radial direction of a shaft. In the present application, an axial direction means an axial direction of a shaft. In the present application, a circumferential direction means a circumferential direction of a shaft.

Figure 1:
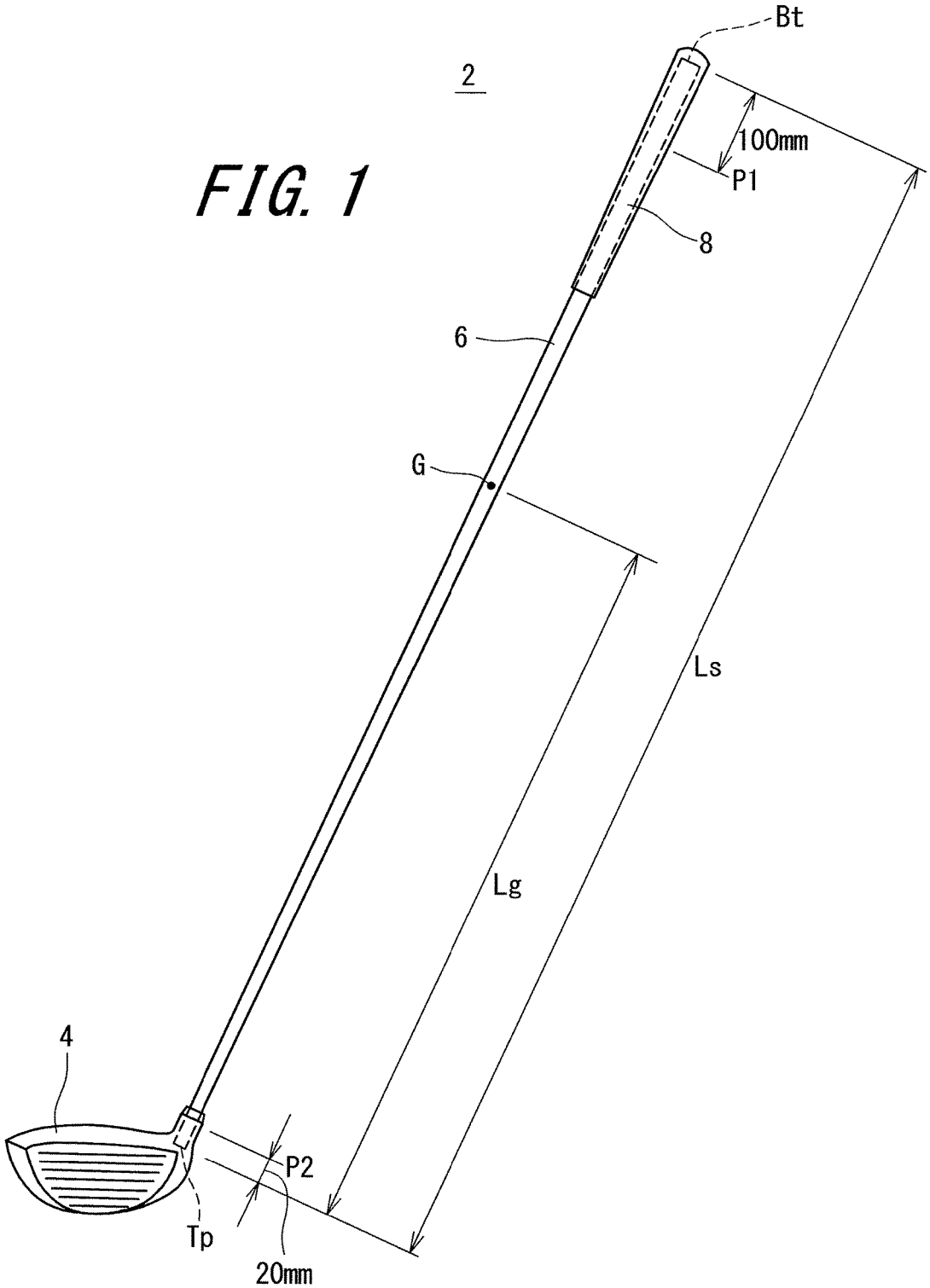
FIG. 1 shows a golf club including a shaft according to a first embodiment.

FIG. 1 shows a golf club 2 according to an embodiment of the present invention. The golf club 2 includes a head 4, a shaft 6 and a grip 8. The head 4 is provided on a tip part of the shaft 6. The grip 8 is provided on a butt part of the shaft 6. The shaft 6 is a shaft for wood type.

The head 4 and the grip 8 are not restricted. Examples of the head 4 include a wood type golf club head, an iron type golf club head, and a putter head.

The shaft 6 is formed by a plurality of fiber reinforced resin layers. The shaft 6 is a tubular body. Although not shown in the drawings, the shaft 6 has a hollow structure. As shown in FIG. 1, the shaft 6 has a tip end Tp and a butt end Bt. In the golf club 2, the tip end Tp is positioned in the head 4. In the golf club 2, the butt end Bt is positioned in the grip 8.

The shaft 6 is formed by winding a plurality of prepreg sheets. In these prepreg sheets, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, in the prepreg sheet, fibers may be woven.

The prepreg sheet has a fiber and a resin. The resin is also referred to as a matrix resin. Examples of the fiber include a carbon fiber and a glass fiber. The matrix resin is typically a thermosetting resin.

The shaft 6 is manufactured by a so-called sheet winding process. In the prepreg, the matrix resin is in a semicured state. In the shaft 6, the prepreg sheet is wound and cured. The curing means the curing of the semicured matrix resin. The curing is attained by heating. The manufacturing process of the shaft 6 includes a heating process. The heating cures the matrix resin of the prepreg sheet.

Figure 2:
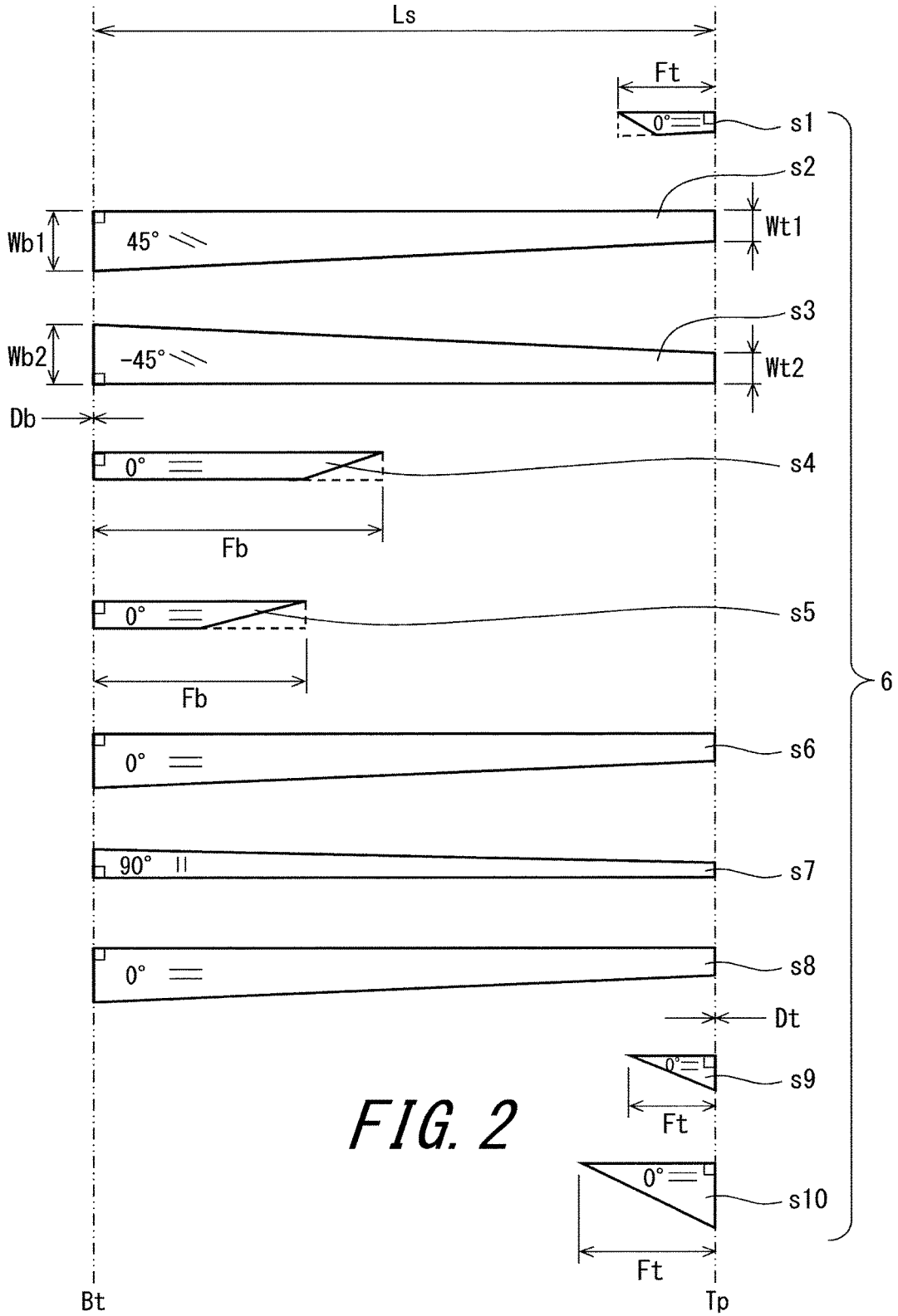
FIG. 2 is a developed view of the shaft.

FIG. 2 is a developed view of the prepreg sheets constituting the shaft 6. FIG. 2 shows the sheets constituting the shaft 6. The shaft 6 includes a plurality of sheets. In the embodiment of FIG. 2, the shaft 6 includes ten sheets. The shaft 6 includes a first sheet s1 to a 10th sheet s10. The developed view shows the sheets constituting the shaft in order from the radial inner side of the shaft. The sheets are wound in order from the sheet positioned on the uppermost side in FIG. 2. In FIG. 2, the horizontal direction of the figure coincides with the axial direction of the shaft. In FIG. 2, the right side of the figure is the tip side of the shaft. In FIG. 2, the left side of the figure is the butt side of the shaft.

FIG. 2 shows not only the winding order but also the arrangement of the sheets in the axial direction. For example, in FIG. 2, one end of the sheet s1 is positioned on the tip end Tp.

The shaft 6 has a straight layer and a bias layer. In FIG. 2, the orientation angle of the fiber is described. A sheet described as "0°" is a straight sheet. The straight sheet constitutes the straight layer.

The straight layer is a layer in which the orientation of the fiber is substantially 0 degree to the axial direction. Usually, the orientation of the fiber is not to be completely parallel to the axis direction of the shaft due to an error or the like in winding. In the straight layer, an absolute angle θa of the fiber to the axis line of the shaft is equal to or less than 10 degrees. The absolute angle θa is an absolute value of an angle between the axis line of the shaft and the direction of the fiber. That is, the absolute angle θa of equal to or less than 10 degrees means that an angle Af between the direction of the fiber and the axis direction of the shaft is −10 degrees or greater but +10 degrees or less.

In the embodiment of FIG. 2, the straight sheets are the sheet s1, the sheet s4, the sheet s5, the sheet s6, the sheet s8, the sheet s9 and the sheet s10. The straight layer contributes to improvement of a flexural rigidity and a flexural strength.

The bias layer can enhance the torsional rigidity and the torsional strength of the shaft. Preferably, the bias layer includes a pair of sheets in which the orientations of the fibers are inclined in opposite directions to each other. Preferably, the pair of sheets include a layer having an angle Af of −60 degrees or greater but −30 degrees or less and a layer having an angle Af of 30 degrees or greater but 60 degrees or less. That is, preferably, the absolute angle θa in the bias layer is 30 degrees or greater but 60 degrees or less.

In the shaft 6, sheets constituting the bias layer are the sheet s2 and the sheet s3. In FIG. 2, the angle Af is described in each sheet. The plus (+) and minus (−) in the angle Af show that the fibers of bias sheets stacked to each other are inclined in opposite directions to each other. In the present application, the sheet for the bias layer is also simply referred to as a bias sheet.

A hoop layer is a layer in which the fiber is oriented along the circumferential direction of the shaft. Preferably, the absolute angle θa in the hoop layer is substantially 90 degrees to the axis line of the shaft. However, the orientation of the fiber to the axis direction of the shaft may not be completely set to 90 degrees due to an error or the like in winding. Normally, in the hoop layer, the absolute angle θa is equal to or greater 80 degrees. The upper limit value of the absolute angle θa is 90 degrees.

The hoop layer contributes to increases in the crushing rigidity and the crushing strength of the shaft. The crushing rigidity is a rigidity against a crushing deformation. The crushing deformation is generated by a force crushing the shaft toward the inside in the radial direction thereof. In a typical crushing deformation, the cross section of the shaft is deformed from a circular shape to an elliptical shape. The crushing strength is a strength against the crushing deformation. The crushing strength can also be involved with the flexural strength. Crushing deformation can be generated with flexural deformation. In a particularly thin lightweight shaft, this interlocking property is large. The increase in the crushing strength can also cause the increase in the flexural strength.

In the embodiment of FIG. 2, a prepreg sheet for the hoop layer is the sheet s7. The prepreg sheet for the hoop layer is also referred to as a hoop sheet.

The prepreg sheet before being used is sandwiched between cover sheets. The cover sheets are usually a mold release paper and a resin film. That is, the prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a mold release paper side surface", and the surface on which the resin film is applied is also referred to as "a film side surface".

In order to wind the prepreg sheet, the resin film is first peeled. The film side surface is exposed by peeling the resin film. The exposed surface has tacking property (tackiness). The tacking property is caused by the matrix resin. That is, since the matrix resin is in a semicured state, the tackiness is developed. Next, the edge part of the exposed film side surface (also referred to as a winding start edge part) is applied on a wound object. The winding start edge part can be smoothly applied by the tackiness of the matrix resin. The wound object is a mandrel or a wound article obtained by winding another prepreg sheet around the mandrel. Next, the mold release paper is peeled. Next, the wound object is rotated to wind the prepreg sheet around the wound object. Thus, after the winding start edge part is applied on the wound object, the mold release paper is peeled. The procedure suppresses the wrinkles and winding fault of the sheet.

A united sheet is used in the embodiment of FIG. 2. The united sheet is formed by stacking a plurality of sheets.

Two united sheets are formed in the embodiment of FIG. 2. A first united sheet is a combination of the sheet s2 and the sheet s3. The first united sheet is a bias united sheet. The sheet s2 and the sheet s3 are stacked to each other to obtain the bias united sheet. A second united sheet is a combination of the sheet s7 and the sheet s8. The sheet s7 and the sheet s8 are stacked to each other to obtain a hoop straight united sheet.

As described above, in the present application, the sheet and the layer are classified by the orientation angle of the fiber. In addition, in the present application, the sheet and the layer are classified by the length thereof in the axial direction.

A layer disposed wholly in the axial direction is referred to as a full length layer. A sheet disposed wholly in the axial direction is referred to as a full length sheet. The wound full length sheet forms the full length layer.

Meanwhile, a layer disposed partially in the axial direction is referred to as a partial layer. A sheet disposed partially in the axial direction is referred to as a partial sheet. The wound partial sheet forms the partial layer.

The full length layer that is the bias layer is referred to as a full length bias layer. In the present application, the full length layer that is the straight layer is referred to as a full length straight layer. In the present application, the full length layer that is the hoop layer is referred to as a full length hoop layer.

The partial layer that is the bias layer is referred to as a partial bias layer. In the present application, the partial layer that is the straight layer is referred to as a partial straight layer.

Hereinafter, the manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets are stacked in the stacking process to produce the united sheets. In the stacking process, heating or a press may be used.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet on the mandrel.

A winding body is obtained by the winding process. The winding body is obtained by winding the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wound around the outer peripheral surface of the winding body in the tape wrapping process. The tape is also referred to as a wrapping tape. The wrapping tape is wound while tension is applied to the wrapping tape. A pressure is applied to the winding body by the wrapping tape. The pressure contributes to reduced voids.

(5) Curing Process

In the curing process, the winding body after being subjected to the tape wrapping is heated. The heating cures the matrix resin. In the curing process, the matrix resin fluidizes temporarily. The fluidization of the matrix resin can discharge air that exists between the sheets or in the sheet. The fastening force of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is performed preferably after the process of extracting the mandrel.

(7) Process of Cutting Both End Parts

The both end parts of the cured laminate are cut in the process. The cutting flattens the end face of the tip end Tp and the end face of the butt end Bt.

(8) Polishing Process

The surface of the cured laminate is polished in the process. Spiral unevenness left behind as the trace of the wrapping tape exists on the surface of the cured laminate. The polishing extinguishes the unevenness to smooth the surface of the cured laminate.

(9) Coating Process

The cured laminate after the polishing process is subjected to coating.

In the present application, the same reference character is used in the layer and the sheet. For example, a layer formed by the sheet s1 is the layer s1.

In the shaft 6, the full length sheets are the sheet s2, the sheet s3, the sheet s6, the sheet s7 and the sheet s8. The sheet s2 and the sheet s3 are the full length bias sheets. The sheet s6 and the sheet s8 are the full length straight sheets. The sheet s7 is the full length hoop sheet. The full length bias sheets s2 and s3 are positioned at the innermost side among the full length sheets.

In the shaft 6, the partial sheets are the sheet s1, the sheet s4, the sheet s5, the sheet s9 and the sheet s10. The sheet s1, the sheet s9 and the sheet s10 are the tip partial sheets. The sheet s4 and the sheet s5 are butt partial sheets.

A double-pointed arrow Dt in FIG. 2 represents a distance between the tip partial sheet and the tip end Tp. The distance Dt is measured along the axial direction. In hitting, stress is apt to be concentrated on the vicinity of the end face of the hosel. In this respect, the distance Dt is preferably equal to or less than 20 mm. In other words, the tip partial sheet is preferably disposed to include a position P2 separated by 20 mm from the tip end Tp. The position P2 is shown in FIG. 1. The distance Dt is more preferably equal to or less than 10 mm. The distance Dt may be 0 mm. In the embodiment, the distance Dt is 0 mm.

A double-pointed arrow Ft in FIG. 2 represents a length (full length) of the tip partial sheet. The length Ft is measured along the axial direction. In hitting, stress is apt to be concentrated on the vicinity of the end face of the hosel. In this respect, the length Ft is preferably equal to or greater than 50 mm, more preferably equal to or greater than 100 mm, and still more preferably equal to or greater than 150 mm. In respect of the position of the center of gravity of the shaft, the length Ft is preferably equal to or less than 400 mm, more preferably equal to or less than 350 mm, and still more preferably equal to or less than 300 mm.

A double-pointed arrow Db in FIG. 2 represents a distance between the butt partial sheet and the butt end Bt. The distance Db is measured along the axial direction. In respect of the position of the center of gravity of the shaft, the distance Db is preferably equal to or less than 100 mm. In other words, the butt partial sheet is preferably disposed to include a position P1 separated by 100 mm from the butt end Bt. The position P1 is shown in FIG. 1. The distance Db is more preferably equal to or less than 70 mm, and still more preferably equal to or less than 50 mm. The distance Db may be 0 mm. In the embodiment, the distance Db is 0 mm.

A double-pointed arrow Fb in FIG. 2 represents a length (full length) of the butt partial sheet. The length Fb is measured along the axial direction. In respect of the position of the center of gravity of the shaft, the weight of the butt partial sheet is preferably great. In this respect, the length Fb is equal to or greater than 250 mm, more preferably equal to or greater than 300 mm, and still more preferably equal to or greater than 350 mm. An excessively large length Fb reduces the effect of shifting the position of the center of gravity of the shaft. In this respect, the length Fb is preferably equal to or less than 650 mm, more preferably equal to or less than 600 mm, still more preferably equal to or less than 580 mm, and yet still more preferably equal to or less than 560 mm.

The first butt partial sheet s4 is the straight sheet. The distance Db of the first butt partial sheet s4 is 0 mm. The butt partial sheet s4 is disposed outside the full length bias sheets s2 and s3. At least one full length straight sheet is provided outside the butt partial sheet s4.

The second butt partial sheet s5 is the straight sheet. The distance Db of the second butt partial sheet s5 is 0 mm. The butt partial sheet s5 is disposed outside the full length bias sheets s2 and s3. At least one full length straight sheet is provided outside the butt partial sheet s5.

The sheet s1 is the straight tip partial sheet. The sheet s1 is disposed inside the full length bias sheets s2 and s3.

In the embodiment, a glass fiber reinforced prepreg is used. In the embodiment, the glass fiber is oriented substantially in one direction. That is, the glass fiber reinforced prepreg is a UD prepreg. A glass fiber reinforced prepreg other than the UD prepreg may be used. For example, glass fibers contained in the prepreg may be woven.

The sheet s1 is a glass fiber reinforced sheet. The sheet s1 is the tip partial sheet that forms the innermost layer.

The sheet s4 is a glass fiber reinforced sheet. The sheet s4 is the butt partial sheet. The first butt partial sheet s4 is longer than the second butt partial sheet s5.

The sheet s9 is a glass fiber reinforced sheet. The sheet s9 is the tip partial sheet. The sheet s9 is the straight sheet. The sheet s9 is positioned outside the outermost full length straight sheet s8. The tip partial sheet s10 is disposed outside the sheet s9. The sheet s10 is a carbon fiber reinforced sheet. The length Ft of the sheet s10 is longer than the length Ft of the sheet s9.

A prepreg other than the glass fiber reinforced prepreg is a carbon fiber reinforced prepreg. Sheets other than the sheets s1, s4 and s9 are carbon fiber reinforced sheets. Examples of the carbon fiber include a PAN based carbon fiber and a pitch based carbon fiber.

The glass fiber reinforced sheet s9 is covered with the carbon fiber reinforced sheet s10. By polishing, the surface layer of the sheet s10 is eliminated, but the sheet 9 is not eliminated. The glass fiber reinforced layer is never eliminated by polishing.

The sheet s9 is a low-elastic layer. The low-elastic layer means a layer reinforced by a fiber having a tensile elastic modulus of equal to or less than 22 tf/mm$^2$. Examples of the low-elastic layer include a low-elastic carbon fiber reinforced layer in addition to the glass fiber reinforced layer. Preferably, the carbon fiber used in the low-elastic carbon fiber reinforced layer is a pitch based carbon fiber.

Thus, in the shaft 6, the tip partial sheets include the outer low-elastic layer s9 and the inner glass fiber reinforced layer s1 disposed inside the outer low-elastic layer s9. The tensile elastic modulus of the fiber contained in the layer s9 is equal to or less than 22 tf/mm$^2$.

The inner layer is close to the neutral axis of the section of the shaft (the axis line of the shaft). Therefore, a tensile stress and a compressive stress which act on the inner layer are smaller than those of the outer layer. Meanwhile, the glass fiber reinforced layer can improve an impact-absorbing energy. The inside disposal of the glass fiber reinforced layer s1 is effective in improvement of the impact-absorbing energy (effect A).

In the shaft 6, the inner glass fiber reinforced layer s1 is positioned inside the bias layers s2 and s3. Therefore, the effect A can be improved.

In the shaft 6, the inner glass fiber reinforced layer s1 is the innermost layer. Therefore, the effect A can be further improved.

The elastic modulus of the glass fiber is approximately equal to or greater than 7 to 8 tf/mm$^2$. This elastic modulus is comparatively low. The reduction of the rigidity is suppressed by disposing the low-elastic glass fiber in the inner layer. That is, in the shaft 6, an impact strength is enhanced by utilizing the inner layer in which the contribution degree of the flexural rigidity is low. In the shaft 6, the flexural rigidity is secured, and the impact strength is improved.

The outer low-elastic layer s9 contains a glass fiber. The glass fiber has a large compressive breaking strain. The glass fiber is effective in improvement of the impact-absorbing energy. The impact-absorbing energy is enhanced by disposing the glass fiber reinforced layer both on the inside and the outside (effect B).

In the shaft 6, the outer low-elastic layer s9 is positioned outside the inner glass fiber reinforced layer s1. Therefore, the effect B can be improved.

In the shaft 6, the outer low-elastic layer s9 is positioned outside all of the full length layers. Therefore, the effect B can be further improved.

The inner glass fiber reinforced layer s1 is positioned inside all of the full length layers. Meanwhile, the outer low-elastic layer s9 is positioned outside all of the full length layers. A radial-directional distance between the layer s1 and the layer s9 is large. Therefore, the effect A and the effect B can be synergistically exhibited.

In respect of enhancing the synergistic effect of the effect A and effect B, a radial-directional distance d1 between the inner glass fiber reinforced layer s1 and the outer low-elastic carbon fiber reinforced layer s9 is preferably equal to or greater than 1.0 mm, more preferably equal to or greater than 1.2 mm, and still more preferably equal to or greater than 1.4 mm. Since the diameter of the tip end of the shaft is restricted, the distance d1 is normally equal to or less than 1.8 mm.

The fiber contained in the outer low-elastic layer s9 may be a carbon fiber. Preferably, the carbon fiber is a pitch based carbon fiber. A low-elastic fiber is largely elongated at breaking. The elongation at breaking contributes to improvement of the impact-absorbing energy.

When the fiber of the outer low-elastic layer s9 is a carbon fiber, the carbon fiber preferably has a tensile elastic modulus of equal to or greater than 5 tf/mm$^2$, and more preferably equal to or greater than 10 tf/mm$^2$. In this case, an excessive deterioration of the flexural rigidity can be suppressed. In respect of the impact-absorbing energy, the tensile elastic modulus of the carbon fiber is preferably equal to or less than 15 tf/mm$^2$.

In respect of a degree of freedom in design, a shaft weight is preferably equal to or greater than 50 g, more preferably equal to or greater than 53 g, and still more preferably equal to or greater than 55 g. In respect of easiness of swing, the shaft weight is preferably equal to or less than 80 g, more preferably equal to or less than 70 g, and still more preferably equal to or less than 65 g.

In respect of enhancing the effect of the position of the center of gravity, a shaft length Ls is preferably equal to or greater than 1079 mm, more preferably equal to or greater than 1105 mm, still more preferably equal to or greater than 1130 mm, and yet still more preferably equal to or greater than 1143 mm. In consideration of the rule, the shaft length Ls is preferably equal to or less than 1181 mm.

Examples of the matrix resin of the prepreg sheet include a thermosetting resin and a thermoplastic resin. In respect of strength of the shaft, the matrix resin is preferably the epoxy resin.

As described above, the sheets forming the shaft 6 include the following (1) to (4).

(1) the full length sheets s2, s3, s6, s7 and s8 disposed wholly in the axial direction (2) the tip partial sheets s1, s9 and s10 disposed to include the position P2 separated by 20 mm from the tip end of the shaft (3) the first butt partial sheet s4 disposed to include the position P1 separated by 100 mm from the butt end of the shaft (4) the second butt partial sheet s5 disposed to include the position P1 separated by 100 mm from the butt end of the shaft In the embodiment, the first butt partial sheet s4 is positioned inside the second butt partial sheet s5. Another sheet may be provided between the first butt partial sheet s4 and the second butt partial sheet s5. The first butt partial sheet may be positioned outside the second butt partial sheet.

Figure 3:
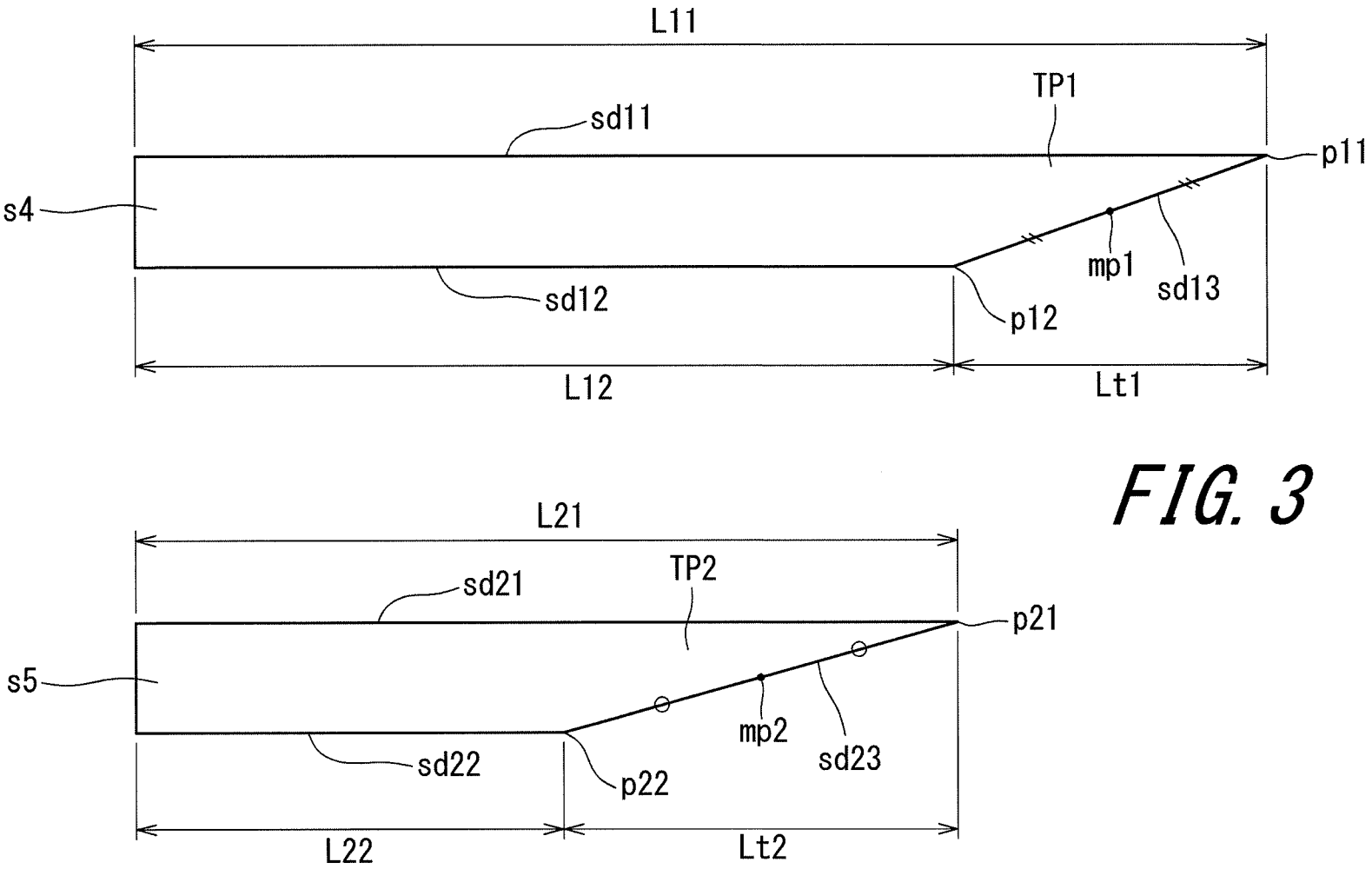
FIG. 3 is enlarged views of a first butt partial sheet and a second butt partial sheet.

FIG. 3 is enlarged views of the first butt partial sheet s4 and the second butt partial sheet s5.

The first butt partial sheet s4 has a tapered part TP1. The tapered part of the first butt partial sheet is also referred to as a first tapered part. The first tapered part TP1 is formed on the tip side of the first butt partial sheet s4. The first tapered part TP1 is formed by cutting a part of a quadrangular sheet at a bevel. The dashed line in FIG. 2 represents the portion cut off by the cutting at a bevel.

The second butt partial sheet s5 has a tapered part TP2. The tapered part of the second butt partial sheet is also referred to as a second tapered part. The second tapered part TP2 is formed on the tip side of the second butt partial sheet s5. The second tapered part TP2 is formed by cutting a part of a quadrangular sheet at a bevel. The dashed line in FIG. 2 represents the portion cut off by the cutting at a bevel.

The tapered part means a part in which the number of plies decreases toward the tip end Tp. The number of plies means the number of windings. For example, when the number of plies is one, the sheet is wound by one round in the circumferential direction. For example, when the number of plies is 0.5, the sheet is wound by half a round in the circumferential direction.

FIG. 3 shows lengths L11, L12, L21, L22, Lt1 and Lt2. These lengths are measured along the axial direction.

The length L11 is the axial-directional length of a long side sd11 of the first butt partial sheet s4. The length L11 is equal to the length Fb of the first butt partial sheet s4. The long side sd11 is a straight line.

The length L12 is the axial-directional length of a short side sd12 of the first butt partial sheet s4. The short side sd12 is a straight line. The short side sd12 is parallel to the long side sd11. The short side sd12 may not be parallel to the long side sd11.

The length Lt1 is the axial-directional length of the first tapered part TP1. The length Lt1 is equal to the axial-directional length of an oblique side sd13 of the first butt partial sheet s4. The oblique side sd13 connects a point p11 and a point p12. The point p11 is an endpoint at the tip side of the long side sd11. The point p12 is an endpoint at the tip side of the short side sd12. The oblique side sd13 is a straight line. The point p11 is the closest point to the tip side on the first butt partial sheet s4.

The length L21 is the axial-directional length of a long side sd21 of the second butt partial sheet s5. The length L21 is equal to the length Fb of the second butt partial sheet s5. The long side sd21 is a straight line.

The length L22 is the axial-directional length of a short side sd22 of the second butt partial sheet s5. The short side sd22 is a straight line. The short side sd22 is parallel to the long side sd21. The short side sd22 may not be parallel to the long side sd21.

The length Lt2 is the axial-directional length of the second tapered part TP2. The length Lt2 is equal to the axial-directional length of an oblique side sd23 of the second butt partial sheet s5. The oblique side sd23 connects a point p21 and a point p22. The point p21 is an endpoint at the tip side of the long side sd21. The point p22 is an endpoint at the tip side of the short side sd22. The oblique side sd23 is a straight line. The point p21 is the closest point to the tip side on the second butt partial sheet s5.

A fiber weight per unit area of the first butt partial sheet is defined as CF1 (g/m$^2$). The fiber weight per unit area means a weight of a fiber per unit area. A fiber elastic modulus of the first butt partial sheet s4 is defined as Te1 (tf/mm$^2$).

A fiber weight per unit area of the second butt partial sheet s5 is defined as CF2 (g/m$^2$). A fiber elastic modulus of the second butt partial sheet is defined as Te2 (tf/mm$^2$).

The shaft 6 satisfies the following formulas (1), (2), (3) and (4).

$$L11>L21 \quad (1)$$

$$Lt1 \geq CF1 \times Te1/20 \quad (2)$$

$$Lt2 \geq CF2 \times Te2/20 \quad (3)$$

$$L21-L12<50 \quad (4)$$

A shaft is deformed during a swing. The deformation is mainly flexure. The amount and the shape of the flexure are changed from moment to moment. Such a change during a swing is also referred to as a shaft behavior.

An EI value is an index showing a flexural rigidity at each position of a shaft. If the EI value is sharply changed, the shaft behavior is not stabilized. In this case, the hitting results are not stabilized. If the EI value is sharply changed, a natural flexure cannot be obtained, and the feeling is apt to be worsened. The sharp change of the EI value can deteriorate the easiness of swing.

A boundary between a region on which the partial sheet exists and a region on which the partial sheet does not exist is formed at an end part of the partial sheet. The EI value is apt to be changed at the boundary. As already mentioned, the change of the EI value is preferably suppressed.

The first butt partial sheet s4 is longer than the second butt partial sheet s5. In the shaft 6 satisfying the formula (1), an end part of the first butt partial sheet s4 and an end part of the second butt partial sheet s5 are dispersed in the axial direction. In the shaft 6 satisfying the formula (1), the sharp change of the EI value is suppressed. Therefore, the shaft behavior is stabilized, and the easiness of swing can be accomplished.

As CF1 is larger, the EI value is more apt to be sharply changed. As Te1 is larger, the EI value is more apt to be sharply changed. It is preferable to set the length Lt1 to a value corresponding to CF1 and Te1. In the shaft 6 satisfying the formula (2), the length Lt1 corresponding to CF1 and Te1 is secured. For example, even when CF1 and Te1 are large, the first tapered part TP1 can suppress a sharp change of the EI value.

As CF2 is larger, the EI value is more apt to be sharply changed. As Te2 is larger, the EI value is more apt to be sharply changed. It is preferable to set the length Lt2 to a value corresponding to CF2 and Te2. In the shaft 6 satisfying the formula (3), the length Lt2 corresponding to CF2 and Te2 is secured. For example, even when CF2 and Te2 are large, the second tapered part TP2 can suppress a sharp change of the EI value.

As to the formula (2), the value of [CF1×Te1/20] is defined as X1. As to the formula (3), the value of [CF2×Te2/20] is defined as X2. In respect of suppressing an EI change rate, a sum (X1+X2) of X1 and X2 is preferably equal to or less than 230, more preferably equal to or less than 220, and still more preferably equal to or less than 210. If (X1+X2) is excessively small, the rigidity of the butt part may be excessively small. In this respect, (X1+X2) is preferably equal to or greater than 100, more preferably equal to or greater than 120, and still more preferably equal to or greater than 140.

In respect of suppressing the EI change rate, the length Lt1 is preferably equal to or greater than 100 mm, more preferably equal to or greater than 110 mm, and still more preferably equal to or greater than 120 mm. If the length Lt1 is excessively large, the workability of winding the first butt partial sheet can be deteriorated. In this respect, the length Lt1 is preferably equal to or less than 250 mm, more preferably equal to or less than 240 mm, and still more preferably equal to or less than 230 mm.

In respect of suppressing the EI change rate, the length Lt2 is preferably equal to or greater than 100 mm, more preferably equal to or greater than 110 mm, and still more preferably equal to or greater than 120 mm. If the length Lt2 is excessively large, the workability of winding the second butt partial sheet can be deteriorated. In this respect, the length Lt2 is preferably equal to or less than 250 mm, more preferably equal to or less than 240 mm, and still more preferably equal to or less than 230 mm.

In respect of suppressing the EI change rate, at least any one of the first butt partial sheet and the second butt partial sheet is preferably a low-elastic sheet. The low-elastic sheet means a sheet reinforced by a fiber having a tensile elastic modulus of equal to or less than 22 tf/mm$^2$. A preferable low-elastic sheet is a sheet reinforced by a fiber having a tensile elastic modulus of equal to or less than 15 tf/mm$^2$.

In respect of suppressing the EI change rate, any one of the first butt partial sheet and the second butt partial sheet is the low-elastic sheet, and the other may be a middle-elastic sheet. The middle-elastic sheet means a sheet reinforced by a fiber having a tensile elastic modulus of greater than 22 tf/mm$^2$ but less than 50 tf/mm$^2$. A preferable middle-elastic sheet is a sheet reinforced by a fiber having a tensile elastic modulus of greater than 22 tf/mm$^2$ but equal to or less than 40 tf/mm$^2$.

The formula (4) shows that the difference (L21−L12) is less than 50 mm. In the shaft 6 satisfying the formula (4), the end parts of the two partial sheets s4 and s5 are effectively dispersed. Therefore, the EI change rate is suppressed.

In respect of suppressing the EI change rate, the difference (L21−L12) is preferably equal to or less than 45 mm, more preferably equal to or less than 40 mm, and still more preferably equal to or less than 35 mm. In respect of effectively increasing Lg/Ls, the difference (L21−L12) is preferably equal to or greater than −50 mm, more preferably equal to or greater −45 mm, still more preferably equal to or greater than −40 mm, and yet still more preferably equal to or greater than −35 mm. In examples described later, the difference (L21−L12) is equal to or greater than 0 mm.

The shaft 6 may satisfy the following formula (5).

$$(L11+L12)/2>L21 \quad (5)$$

In the shaft 6 satisfying the formula (5), the end parts of the two partial sheets s4 and s5 are effectively dispersed. In the shaft 6, satisfying the formula (5) means that a middle point mp1 of the oblique side sd13 is positioned on the tip side relative to the point p21 (See FIG. 3). Therefore, the EI change rate is suppressed.

The shaft 6 may satisfy the following formula (6).

$$(L21+L22)/2<L12 \quad (6)$$

In the shaft 6 satisfying the formula (6), the end parts of the two partial sheets s4 and s5 are effectively dispersed. In the shaft 6, satisfying the formula (6) means that a middle point mp2 of the oblique side sd23 is positioned on the butt side relative to the point p12 (See FIG. 3). Therefore, the EI change rate is suppressed.

A double-pointed arrow Wt1 in FIG. 2 shows a width of the tip end of the bias sheet s2. A double-pointed arrow Wt2 in FIG. 2 shows a width of the tip end of the bias sheet s3. A total width Wt at the tip end of the full length bias sheets is the sum of Wt1 and Wt2.

A double-pointed arrow Wb1 in FIG. 2 shows a width of the butt end of the bias sheet s2. A double-pointed arrow Wb2 in FIG. 2 shows a width of the butt end of the bias sheet s3. A total width Wb at the butt end of the full length bias sheets is the sum of Wb1 and Wb2.

As shown in FIG. 2, in the sheet s2, the sheet width is gradually increased toward the butt side. Similarly, in the sheet s3, the sheet width is gradually increased toward the butt side. The width Wb1 is the maximum width of the sheet s2. The width Wt1 is the minimum width of the sheet s2. The width Wb2 is the maximum width of the sheet s3. The width Wt2 is the minimum width of the sheet s3.

In respect of increasing Lg/Ls, Wb/Wt is preferably equal to or greater than 2, more preferably equal to or greater than 2.3, and still more preferably equal to or greater than 2.5. In respect of suppressing a distortion at the tip part of the shaft, Wb/Wt is preferably equal to or less than 3, and more preferably equal to or less than 2.7.

The EI value of the shaft 6 can be measured at each position of the shaft 6. As shown in examples described later, the EI value is measured at intervals of 100 mm. This 100 mm is a distance in the axial direction. A measurement point that is the closest to the tip end Tp is set on a point separated by 130 mm from the tip end Tp. This 130 mm is a distance in the axial direction. The measurement is performed on as many points as possible, as long as the measurement can be performed by the method described later.

In the shaft 6, the EI change rate is equal to or less than 13 kgf·m$^2$/m over the whole shaft. The EI change rate is calculated based on the all measured values. Suppression of the EI change rate stabilizes the shaft behavior to accomplish the easiness of swing. The EI change rate is defined as an absolute value.

A double-pointed arrow Lg in FIG. 1 shows a distance between the tip end Tp and the center of gravity G of the shaft. The distance Lg is measured along the axial direction. A double-pointed arrow Ls in FIG. 1 shows the length of the shaft 6.

Even when the head weight is increased, the easiness of swing is secured by increasing Lg/Ls. Therefore, the flight distance can be increased. In this respect, Lg/Ls is preferably equal to or greater than 0.555, more preferably equal to or greater than 0.557, and still more preferably equal to or greater than 0.559. In consideration of the strength of the tip part, Lg/Ls is preferably equal to or less than 0.600, and more preferably equal to or less than 0.590.

The first butt partial sheet s4 and the second butt partial sheet s5 contribute to the increase of Lg/Ls. In other words, the first butt partial sheet s4 and the second butt partial sheet s5 contribute to making the center of gravity G of the shaft close to the butt end Bt.

When the difference (L11−L21) is excessively small, the effect of suppressing the EI change rate can be reduced. In this respect, the difference (L11−L21) is equal to or greater than 50 mm, more preferably equal to or greater than 100 mm, still more preferably equal to or greater than 120 mm, and yet still more preferably equal to or greater than 140 mm. When the difference (L11−L21) is excessively great, the length L11 might be excessively large, or the length L21 might be excessively small. When the length L11 is excessively large, a degree of distribution concentrated to the butt portion becomes small. In this case, the effect of shifting the center of gravity based on the partial sheet s4 can be reduced. When the length L21 is excessively small, the weight of the second butt partial sheet s5 becomes small. In this case, the effect of shifting the center of gravity based on the partial sheet s5 can be reduced. In these respects, the difference (L11−L21) is equal to or less than 300 mm, more preferably equal to or less than 250 mm, and still more preferably equal to or less than 220 mm.

FIG. 4 is a modified embodiment of the first butt partial sheet s4 and the second butt partial sheet s5. The axial-directional position of the point p21 is positioned between the point p11 and the point p12. Furthermore, the axial-directional position of the point p21 is positioned between the point mp1 and the point p12. In the embodiment of FIG. 4, the degree of distribution concentrated to the butt portion and the dispersion of the ends of the two sheets are accomplished in a well-balanced manner.

The shaft 6 has two butt partial sheets. The number of butt partial sheets may be three or more. In this case, any two of the three or more butt partial sheets can be the first butt partial sheet and the second butt partial sheet.

In the shaft 6, the first butt partial sheet and the second butt partial sheet are straight sheets. The first butt partial sheet and the second butt partial sheet are not restricted to the straight sheets. For example, the first butt partial sheet and the second butt partial sheet may be bias sheets. When the first butt partial sheet and the second butt partial sheet are straight sheets, the EI value is apt to be sharply changed. Therefore, in this case, the above mentioned effect is conspicuous. In this respect, the first butt partial sheet and the second butt partial sheet are preferably straight sheets.

Many types of prepregs are commercially available. An appropriate prepreg can be selected to obtain desired specifications.

EXAMPLES

Hereinafter, the effects of the present invention will be clarified by examples. However, the present invention should not be interpreted in a limited way based on the description of examples.

Example 1

A shaft having the same laminated constitution as that of the shaft 6 was produced. That is, a shaft having the sheet constitution shown in FIG. 2 was produced. A manufacturing method is the same as that of the shaft 6. Trade names of prepregs used for sheets are as follows. The sheet s1, the sheet s4 and the sheet s9 are glass fiber reinforced prepregs. The other sheets are PAN based carbon fiber reinforced prepregs.

sheet s1: GE352H-160S (manufactured by Mitsubishi Rayon Co., Ltd.)

sheet s2: HRX350C-075S (manufactured by Mitsubishi Rayon Co., Ltd.)

sheet s3: HRX350C-075S (manufactured by Mitsubishi Rayon Co., Ltd.)

sheet s4: GE352H-160S (manufactured by Mitsubishi Rayon Co., Ltd.)

sheet s5: TR350C-125S (manufactured by Mitsubishi Rayon Co., Ltd.)

sheet s6: MR350C-100S (manufactured by Mitsubishi Rayon Co., Ltd.)

sheet s7: 805S-3 (manufactured by Toray Industries, Inc.)

sheet s8: MR350C-100S (manufactured by Mitsubishi Rayon Co., Ltd.)

sheet s9: GE352H-160S (manufactured by Mitsubishi Rayon Co., Ltd.)

sheet s10: MR350C-125S (manufactured by Mitsubishi Rayon Co., Ltd.)

The trade name "GE352H-160S" is a glass fiber reinforced prepreg. The glass fiber is E glass, and the tensile elastic modulus of the glass fiber is 7 (tf/mm$^2$).

The specifications and the evaluation results of example 1 are shown in Table 1 below.

Examples 2 to 4 and Comparative Examples 1 to 4

The prepregs of the sheets were changed. The first butt partial sheet and the second butt partial sheet were set as shown in Tables 1 and 2 below. Shafts of examples 2 to 4 and comparative examples 1 to 4 were obtained in the same manner as in example 1 except for the above.

In example 2, the following were used as the first butt partial sheet s4 and the second butt partial sheet s5.

sheet s4: GE352H-160S (manufactured by Mitsubishi Rayon Co., Ltd.)

sheet s5: TR350C-125S (manufactured by Mitsubishi Rayon Co., Ltd.)

In example 3, the following were used as the first butt partial sheet s4 and the second butt partial sheet s5.

sheet s4: GE352H-160S (manufactured by Mitsubishi Rayon Co., Ltd.)

sheet s5: TR350C-125S (manufactured by Mitsubishi Rayon Co., Ltd.)

In example 4, the following were used as the first butt partial sheet s4 and the second butt partial sheet s5.

sheet s4: E1026A-14N (manufactured by Nippon Graphite Fiber Corporation)

sheet s5: TR350C-150S (manufactured by Mitsubishi Rayon Co., Ltd.)

In examples 1 to 3, the first butt partial sheet s4 was the glass fiber reinforced prepreg, and the second butt partial sheet s5 was the PAN based carbon fiber reinforced prepreg. Meanwhile, in example 4, the first butt partial sheet s4 was the pitch based carbon fiber reinforced prepreg, and the second butt partial sheet s5 was the PAN based carbon fiber reinforced prepreg.

In comparative example 1, the following were used as the first butt partial sheet s4 and the second butt partial sheet s5.

sheet s4: GE352H-160S (manufactured by Mitsubishi Rayon Co., Ltd.)

sheet s5: TR350C-150S (manufactured by Mitsubishi Rayon Co., Ltd.)

In comparative example 2, the following were used as the first butt partial sheet s4 and the second butt partial sheet s5.

sheet s4: GE352H-160S (manufactured by Mitsubishi Rayon Co., Ltd.)

sheet s5: TR350C-125S (manufactured by Mitsubishi Rayon Co., Ltd.)

Comparative example 3 was based on comparative example 1, and shapes of the bias sheets s2 and s3 were changed in comparative example 3. Wb/Wt was less than 2. The Shaft of comparative example 3 was obtained in the same manner as in comparative example 1 except for the above.

Comparative example 4 was based on comparative example 1, and the sheet s1 and the sheet s9 were substituted with "TR350C-150S". The Shaft of comparative example 4 was obtained in the same manner as in comparative example 1 except for the above.

The specifications and the evaluation results of examples are shown in Table 1 below. The specifications and the evaluation results of comparative examples are shown in Table 2 below. EI and EI change rates in examples are shown in Table 3 below. EI and EI change rates in comparative examples are shown in Table 4 below.

TABLE 1

Specifications and Evaluation Results of Examples

| | unit | Ex. 1 | Ex. 2 | Ex. 3 | Ex. 4 |
|---|---|---|---|---|---|
| Shaft length Ls | mm | 1168 | 1168 | 1168 | 1168 |
| Shaft weight | g | 58.6 | 58.8 | 58.5 | 59.3 |
| Distance Lg | mm | 649 | 650 | 649 | 649 |
| Lg/Ls | — | 0.556 | 0.557 | 0.556 | 0.556 |
| L11 | mm | 550 | 550 | 530 | 550 |
| L12 | mm | 400 | 400 | 380 | 400 |
| (L11 + L12)/2 | mm | 475 | 475 | 455 | 475 |
| Lt1 | mm | 150 | 150 | 150 | 150 |
| CF1*Te1/20 | — | 56 | 56 | 56 | 77 |
| CF1 | $g/m^2$ | 160 | 160 | 160 | 140 |
| Te1 | $tf/mm^2$ | 7 | 7 | 7 | 11 |
| L21 | mm | 400 | 400 | 415 | 400 |
| L22 | mm | 200 | 250 | 215 | 200 |
| (L21 + L22)/2 | mm | 300 | 325 | 315 | 300 |
| Lt2 | mm | 200 | 150 | 200 | 200 |
| CF2*Te2/20 | — | 150 | 150 | 150 | 180 |
| CF2 | $g/m^2$ | 125 | 125 | 125 | 150 |
| Te2 | $tf/mm^2$ | 24 | 24 | 24 | 24 |
| L21 − L12 | mm | 0 | 0 | 35 | 0 |
| Wb | mm | 165 | 165 | 165 | 165 |
| Wt | mm | 65 | 65 | 65 | 65 |
| Wb/Wt | — | 2.54 | 2.54 | 2.54 | 2.54 |
| Maximum value of EI change rate | $kgf \cdot m^2/m$ | 10.9 | 12.2 | 12.7 | 12.4 |
| Impact-absorbing energy | J | 3.65 | 3.62 | 3.66 | 3.71 |
| Easiness of swing | — | 4.3 | 4.1 | 4.0 | 4.1 |

TABLE 2

Specifications and Evaluation Results of Comparative Examples

| | unit | Comp. Ex. 1 | Comp. Ex. 2 | Comp. Ex. 3 | Comp. Ex. 4 |
|---|---|---|---|---|---|
| Shaft length Ls | mm | 1168 | 1168 | 1168 | 1168 |
| Shaft weight | g | 59.3 | 58.5 | 59.2 | 59.1 |
| Distance Lg | mm | 652 | 649 | 646 | 653 |
| Lg/Ls | — | 0.558 | 0.556 | 0.553 | 0.559 |
| L11 | mm | 550 | 525 | 550 | 555 |

TABLE 2-continued

| Specifications and Evaluation Results of Comparative Examples | | | | | |
|---|---|---|---|---|---|
| | unit | Comp. Ex. 1 | Comp. Ex. 2 | Comp. Ex. 3 | Comp. Ex. 4 |
| L12 | mm | 400 | 375 | 400 | 405 |
| (L11 + L12)/2 | mm | 475 | 450 | 475 | 480 |
| Lt1 | mm | 150 | 150 | 150 | 150 |
| CF1*Te1/20 | — | 56 | 56 | 56 | 56 |
| CF1 | $g/m^2$ | 160 | 160 | 160 | 160 |
| Te1 | $tf/mm^2$ | 7 | 7 | 7 | 7 |
| L21 | mm | 400 | 430 | 400 | 405 |
| L22 | mm | 250 | 230 | 250 | 255 |
| (L21 + L22)/2 | mm | 325 | 330 | 325 | 330 |
| Lt2 | mm | 150 | 200 | 150 | 150 |
| CF2*Te2/20 | — | 180 | 150 | 180 | 180 |
| CF2 | $g/m^2$ | 150 | 125 | 150 | 150 |
| Te2 | $tf/mm^2$ | 24 | 24 | 24 | 24 |
| L21 − L12 | mm | 0 | 55 | 0 | 0 |
| Wb | mm | 165 | 165 | 154 | 165 |
| Wt | mm | 65 | 65 | 78 | 65 |
| Wb/Wt | — | 2.54 | 2.54 | 1.97 | 2.54 |
| Maximum value of EI change rate | $kgf \cdot m^2/m$ | 13.2 | 13.8 | 13.1 | 13.2 |
| Impact-absorbing energy | J | 3.66 | 3.63 | 3.53 | 3.21 |
| Easiness of swing | — | 3.6 | 3.2 | 3.5 | 3.3 |

TABLE 3

| EI and EI change rate in Examples | | | | | | | | |
|---|---|---|---|---|---|---|---|---|
| | Ex. 1 | | Ex. 2 | | Ex. 3 | | Ex. 4 | |
| Distance from tip end (mm) | EI ($kgf \cdot m^2$) | EI change rate ($kgf \cdot m^2/m$) | EI ($kgf \cdot m^2$) | EI change rate ($kgf \cdot m^2/m$) | EI ($kgf \cdot m^2$) | EI change rate ($kgf \cdot m^2/m$) | EI ($kgf \cdot m^2$) | EI change rate ($kgf \cdot m^2/m$) |
| 130 | 2.39 | — | 2.39 | — | 2.39 | — | 2.39 | — |
| 230 | 1.88 | −5.06 | 1.88 | −5.06 | 1.88 | −5.06 | 1.88 | −5.10 |
| 330 | 2.00 | 1.13 | 2.00 | 1.13 | 2.00 | 1.13 | 2.00 | 1.13 |
| 430 | 2.25 | 2.56 | 2.25 | 2.56 | 2.25 | 2.56 | 2.25 | 2.56 |
| 530 | 2.79 | 5.38 | 2.79 | 5.38 | 2.79 | 5.38 | 2.79 | 5.38 |
| 630 | 3.38 | 5.94 | 3.38 | 5.94 | 3.34 | 5.47 | 3.40 | 6.09 |
| 730 | 4.27 | 8.89 | 4.27 | 8.89 | 4.19 | 8.48 | 4.46 | 10.61 |
| 830 | 5.36 | 10.90 | 5.49 | 12.19 | 5.46 | 12.72 | 5.70 | 12.40 |
| 930 | 6.41 | 10.47 | 6.65 | 11.57 | 6.50 | 10.43 | 6.88 | 11.78 |
| 1030 | 7.25 | 8.36 | 7.25 | 5.97 | 7.25 | 7.46 | 7.79 | 9.13 |

TABLE 4

| EI and EI change rate in Comparative Examples | | | | | | | | |
|---|---|---|---|---|---|---|---|---|
| | Comp. Ex. 1 | | Comp. Ex. 2 | | Comp. Ex. 3 | | Comp. Ex. 4 | |
| Distance from tip end (mm) | EI ($kgf \cdot m^2$) | EI change rate ($kgf \cdot m^2/m$) | EI ($kgf \cdot m^2$) | EI change rate ($kgf \cdot m^2/m$) | EI ($kgf \cdot m^2$) | EI change rate ($kgf \cdot m^2/m$) | EI ($kgf \cdot m^2$) | EI change rate ($kgf \cdot m^2/m$) |
| 130 | 2.39 | — | 2.39 | — | 2.36 | — | 2.53 | — |
| 230 | 1.88 | −5.06 | 1.88 | −5.06 | 1.92 | −4.37 | 1.89 | −6.40 |
| 330 | 2.00 | 1.13 | 2.00 | 1.13 | 2.03 | 1.07 | 2.00 | 1.08 |
| 430 | 2.25 | 2.56 | 2.25 | 2.56 | 2.28 | 2.51 | 2.25 | 2.56 |
| 530 | 2.79 | 5.38 | 2.79 | 5.38 | 2.80 | 5.22 | 2.79 | 5.38 |
| 630 | 3.38 | 5.94 | 3.33 | 5.43 | 3.38 | 5.82 | 3.38 | 5.94 |
| 730 | 4.27 | 8.89 | 4.17 | 8.37 | 4.26 | 8.77 | 4.27 | 8.89 |
| 830 | 5.59 | 13.19 | 5.55 | 13.77 | 5.56 | 13.06 | 5.59 | 13.19 |
| 930 | 6.90 | 13.05 | 6.59 | 10.43 | 6.85 | 12.86 | 6.90 | 13.05 |
| 1030 | 7.50 | 6.06 | 7.25 | 6.55 | 7.44 | 5.91 | 7.50 | 6.06 |

[Method for Measuring Impact-Absorbing Energy]

Figure 5:
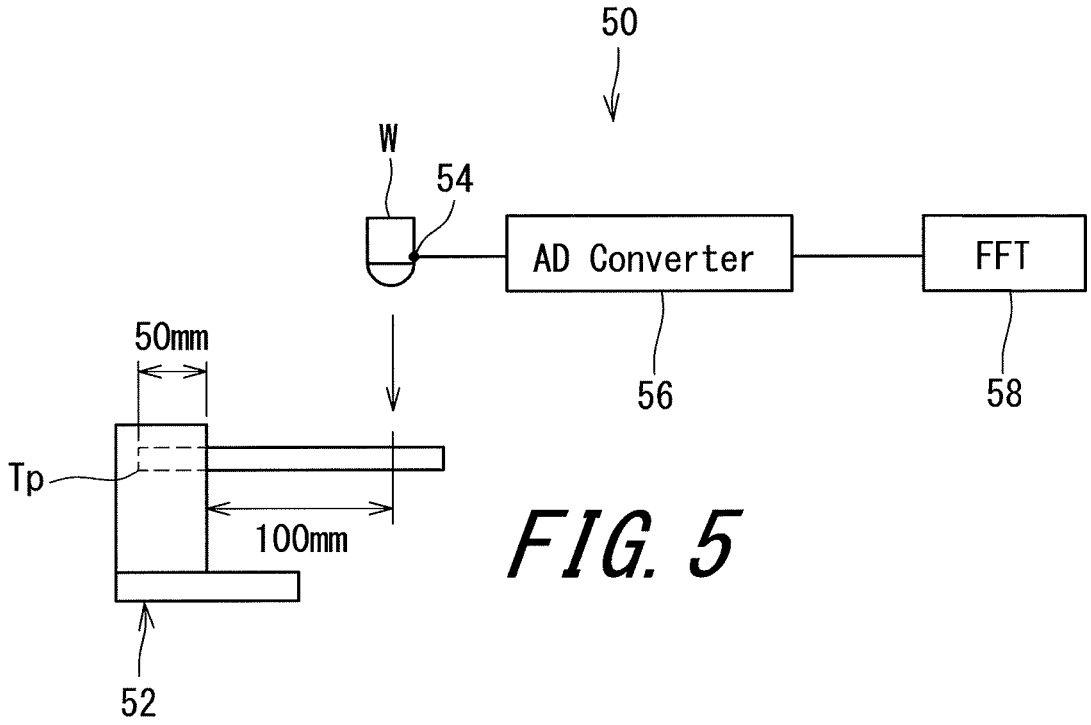
FIG. 5 is a schematic view showing a method for measuring an impact-absorbing energy.

FIG. 5 shows a method for measuring an impact-absorbing energy. An impact test was conducted by a cantilever bending method. A drop weight impact tester (IITM-18) manufactured by Yonekura MFG Co., Ltd. was used as a measuring apparatus 50. A tip end part between the tip end Tp of the shaft and a position separated by 50 mm from the tip end Tp was fixed to a fixing jig 52. A weight W of 600 g was dropped to the shaft at a position separated by 100 mm from the fixed end and the weight W was dropped from the upper side at 1500 mm above the position. An accelerometer 54 was attached to the weight W. The accelerometer 54 was connected to an FFT analyzer 58 through an AD converter 56. A measurement wave profile was obtained by FFT treatment. Displacement D and an impact flexural load L were measured by the measurement to calculate an impact-absorbing energy before breakage started.

Figure 6:
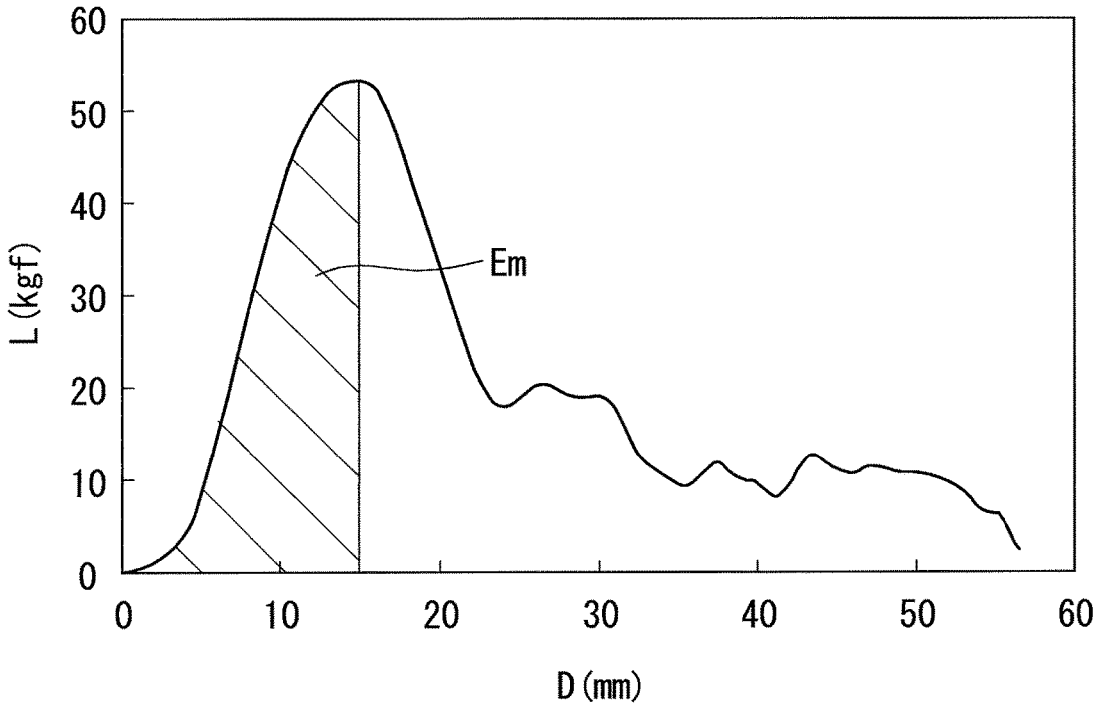
FIG. 6 is a graph showing an example of a wave profile obtained when the impact-absorbing energy is measured.

FIG. 6 is an example of the measured wave profile. The wave profile is a graph showing the relationship between the displacement D (mm) and the impact flexural load L (kgf). In the graph of FIG. 6, the area of a portion represented by hatching represents an impact-absorbing energy Em (J).

[Evaluation on Easiness of Swing]

A 460 cc driver head and a grip were attached to each shaft to obtain golf clubs. Ten golf players having a handicap of 10 or less actually hit balls with the clubs and evaluated easiness of swing of those clubs. Sensuous evaluation was made on a scale of one to five. The higher the score is, the higher the evaluation is. The average scores of the ten golf players are shown in the Tables 1 and 2.

[Measurement of EI]

Measurement points of EI were the following ten points of (1) to (10).

Figure 7:
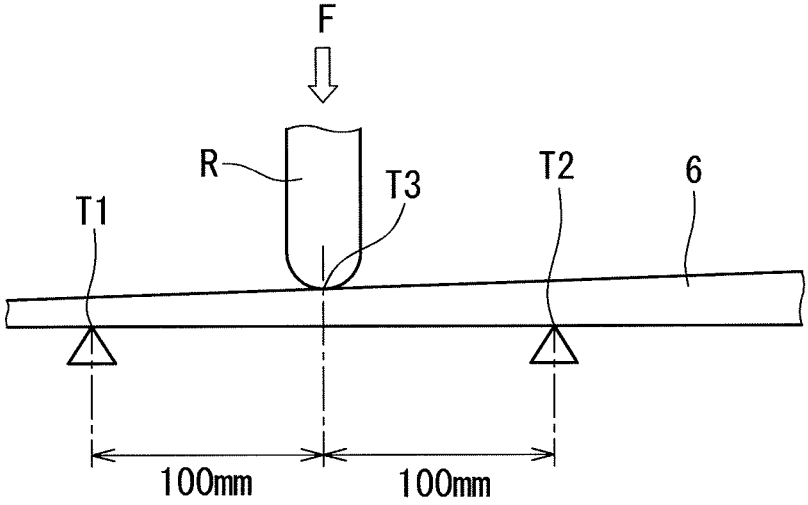
FIG. 7 is a schematic view showing a method for measuring an EI.

(1) a point separated by 130 mm from the tip end Tp
(2) a point separated by 230 mm from the tip end Tp
(3) a point separated by 330 mm from the tip end Tp
(4) a point separated by 430 mm from the tip end Tp
(5) a point separated by 530 mm from the tip end Tp
(6) a point separated by 630 mm from the tip end Tp
(7) a point separated by 730 mm from the tip end Tp
(8) a point separated by 830 mm from the tip end Tp
(9) a point separated by 930 mm from the tip end Tp
(10) a point separated by 1030 mm from the tip end Tp FIG. 7 shows a method for measuring the flexural rigidity EI. EI was measured using a universal material testing machine manufactured by INTESCO Co., Ltd., Type 2020 (maximum load: 500 kg). The shaft 6 was supported from beneath at a first support point T1 and a second support point T2. A load F was applied from above to a measurement point T3 while keeping the support. The direction of the load F was the vertically downward direction. The distance between the point T1 and the point T2 was 200 mm. The measurement point T3 was set to a position by which the distance between the point T1 and the point T2 was divided into two equal parts. A deflection amount H generated by applying the load F was measured. The load F was applied with an indenter R. The tip of the indenter R was a cylindrical surface having a curvature radius of 75 mm. A downwardly moving speed of the indenter R was set to 5 mm/min. The moving of the indenter R was stopped when the load F reached to 20 kgf (196 N), and the deflection amount H at the time was measured. The deflection amount H is an amount of displacement of the point T3 in the vertical direction. EI was calculated by the following formula.

$$EI\ (\mathrm{kgf{\cdot}m^2}) = F \times L^3/48H$$

In the formula, F represents the maximum load (kgf), L represents the distance between the support points (m), and H represent the deflection amount (m). The maximum load F is 20 kgf, and the distance L between the support points is 0.2 m.

EI change rate at each point was calculated by using measured values at the ten measurement points. EI change rates of nine sections were obtained by using respective values of the measurement points and their adjacent points. These values are shown in the Tables 3 and 4. The maximum value among these EI change rates is shown in the Tables 1 and 2.

As shown in Tables 1 and 2, the examples are highly evaluated as compared with the comparative examples. The advantages of the present invention are apparent.

The method described above can be applied to all golf club shafts.

The above description is merely for illustrative examples, and various modifications can be made without departing from the principles of the present invention.

What is claimed is:

1. A golf club shaft comprising a plurality of fiber reinforced layers, wherein:

the fiber reinforced layers are formed by a plurality of wound prepreg sheets;

the sheets include:

a full length sheet disposed wholly in an axial direction;

a tip partial sheet disposed to include a position separated by 20 mm from a tip end of the shaft;

a first butt partial sheet disposed to include a position separated by 100 mm from a butt end of the shaft; and a second butt partial sheet disposed to include a position separated by 100 mm from the butt end of the shaft, the first butt partial sheet includes a first tapered part;

the second butt partial sheet includes a second tapered part;

a fiber weight per unit area of the first butt partial sheet is defined as CF1 (g/m$^2$), and a fiber elastic modulus of the first butt partial sheet is defined as Te1 (tf/mm$^2$), a fiber weight per unit area of the second butt partial sheet is defined as CF2 (g/m$^2$), and a fiber elastic modulus of the second butt partial sheet is defined as Te2 (tf/mm$^2$);

an axial-directional length of a long side of the first butt partial sheet is defined as L11 (mm), and an axial-directional length of a short side of the first butt partial sheet is defined as L12 (mm);

an axial-directional length of a long side of the second butt partial sheet is defined as L21 (mm), and an axial-directional length of a short side of the second butt partial sheet is defined as L22 (mm);

an axial-directional length of the first tapered part is defined as Lt1 (mm);

an axial-directional length of the second tapered part is defined as Lt2 (mm);

the golf club shaft satisfies the following formulas (1), (2), (3) and (4):

$$L11 > L21 \quad (1);$$

$$Lt1 \geq CF1 \times Te1/20 \quad (2);$$

$$Lt2 \geq CF2 \times Te2/20 \quad (3); \text{ and}$$

$$L21 - L12 < 50 \quad (4).$$

2. The golf club shaft according to claim 1, wherein an EI change rate is equal to or less than 13 $kgf \cdot m^2/m$ over the whole shaft.

3. The golf club shaft according to claim 1, wherein when a distance between the tip end and a center of gravity of the shaft is defined as Lg, and a full length of the shaft is defined as Ls, Lg/Ls is equal to or greater than 0.555.

4. The golf club shaft according to claim 1, wherein the full length sheet includes a full length bias sheet, in the full length bias sheet, a total width at the tip end is defined as Wt, and a total width at the butt end is defined as Wb, Wb/Wt is equal to or greater than 2.

5. The golf club shaft according to claim 1, wherein the tip partial sheet includes a glass fiber reinforced sheet.

* * * * *